US009019124B2

(12) United States Patent
Schiff et al.

(10) Patent No.: US 9,019,124 B2
(45) Date of Patent: Apr. 28, 2015

(54) SYSTEM AND METHOD FOR MONITORING AND ALERTING ON EQUIPMENT ERRORS

(71) Applicant: Solar Turbines Incorporated, San Diego, CA (US)

(72) Inventors: Garrett Linn Schiff, San Diego, CA (US); James Anthony Gilbert, San Diego, CA (US); Paul Krupenas, San Diego, CA (US)

(73) Assignee: Solar Turbines Incorporated, San Diego, CA (US)

( * ) Notice: Subject to any disclaimer, the term of this patent is extended or adjusted under 35 U.S.C. 154(b) by 203 days.

(21) Appl. No.: 13/723,053

(22) Filed: Dec. 20, 2012

(65) Prior Publication Data

US 2014/0176345 A1 Jun. 26, 2014

(51) Int. Cl.
*G08B 23/00* (2006.01)

(52) U.S. Cl.
CPC ..... *G08B 23/00* (2013.01)

(58) Field of Classification Search
USPC ..... 340/870.16, 506, 679, 680, 682, 683, 340/3.1, 3.43, 5.1; 702/182, 183, 184, 185
See application file for complete search history.

(56) References Cited

U.S. PATENT DOCUMENTS

| | | | | |
|---|---|---|---|---|
| 5,748,500 | A * | 5/1998 | Quentin et al. | 702/182 |
| 5,835,012 | A | 11/1998 | Wilk | |
| 6,343,251 | B1 | 1/2002 | Herron et al. | |
| 6,542,856 | B2 | 4/2003 | Frantz et al. | |
| 6,728,660 | B2 * | 4/2004 | Bjornson | 702/185 |
| 7,050,943 | B2 | 5/2006 | Kauffman et al. | |
| 7,065,471 | B2 | 6/2006 | Gotoh et al. | |
| 7,470,103 | B2 | 12/2008 | Tisenchek et al. | |
| 7,627,454 | B2 * | 12/2009 | LaComb et al. | 702/182 |
| 7,764,188 | B2 | 7/2010 | O'Neal et al. | |
| 2012/0150491 | A1 * | 6/2012 | Shi et al. | 702/184 |

FOREIGN PATENT DOCUMENTS

| | | | |
|---|---|---|---|
| EP | 2 026 159 | A2 | 2/2009 |
| WO | WO 2006/050187 | A2 | 5/2006 |

* cited by examiner

*Primary Examiner* — Toan N Pham
(74) *Attorney, Agent, or Firm* — Finnegan, Henderson, Farabow, Garrett & Dunner, LLP

(57) ABSTRACT

A system and method is disclosed herein for monitoring and alerting on equipment errors. A server may receive data on a periodic basis. The data is indicative of operational states of at least one machine. The server may then analyze a quality issue associated with the received data over an alert period greater than one day, determine a type of the quality issue, and generate a warning message including an indication of the quality issue and the type of the quality issue.

25 Claims, 8 Drawing Sheets

300

| | GROUP/ALERT NAME | FILTER TYPE | ALERT TYPE | SYSTEM |
|---|---|---|---|---|
| 302 | EXCESSIVE START | | DATA | SUMMARY |
| 304 | EXCESSIVE START | | OPERATION | SUMMARY |
| 306 | ENGINE HOURS - EXCESSIVE POSITIVE STEP | NONE | DATA | SUMMARY |
| 308 | ENGINE HOURS - NEGATIVE STEP | NONE | DATA | SUMMARY |
| 310 | UNIT NOT POSTING >= [5] DAYS | NONE | DATA | SUMMARY |
| 312 | AGE OF UNCHARACTERIZED HOURS >= [3] DAYS | NONE | DATA | SUMMARY |

FIG. 3

800

INSIGHT SYSTEM DIAGNOSTIC ALERT NOTIFICATIONS FOR 11-NOV-2012

NEW ALERTS ARE NOT YET BEING MANAGED AND MAY REQUIRE IMMEDIATE ATTENTION
IN WORK ALERTS - RECURRENCE NOTIFICATIONS INDICATE THAT NEW DATA RECEIVED IN THE LAST 24 HOURS HAS VIOLATED ALERT LIMITS

CLICK ANY SYSTEM LINK TO VIEW THE ENTIRE REPORT, OR CLICK THE ALERT NAME LINK TO VIEW A SINGLE.
CLICK HERE TO LOGIN TO THE INSIGHT SYSTEM MACHINERY MANAGEMENT DASHBOARD.

| NEW ALERTS | | | | | | |
|---|---|---|---|---|---|---|
| SYSTEM | ALERT NAME | FILTER TYPE | ALERT TYPE | COUNT | FIRST ALERT | LAST ALERT |
| ELECTRICAL CONTROL SYSTEMS | (SB 5.13.1/127) REPLACEMENT OF OLDER FLEX I/O MODULES | ALL DATA | SERVICE BULLETIN | 1 | 9/21/2012 06:51 | 9/21/2012 06:51 |
| FUEL SYSTEMS | (SB 3.5/107) LEVEL SWITCH IN COALESCER REQUIRES RECALIBRATION | ALL DATA | SERVICE BULLETIN | 1 | 9/21/2012 06:50 | 9/21/2012 06:50 |
| SUMMARY | AGE OF UNCHARACTERIZED HOURS >= [10] DAYS | NONE | DATA | 599 | 9/25/2012 01:00 | 10/31/2012 23:00 |
| SUMMARY | UNIT NOT POSTING >= [5] DAYS | NONE | DATA | 710 | 10/08/2012 01:00 | 11/06/2012 14:00 |

802

FIG. 8

SYSTEM AND METHOD FOR MONITORING AND ALERTING ON EQUIPMENT ERRORS

TECHNICAL FIELD

The present disclosure is directed to an equipment monitoring and alarm system and, more particularly, to a system and method for monitoring and alerting on equipment errors.

BACKGROUND

Industrial systems, such as turbine engines, air conditioners, and power generators, are becoming more complex, often including a large number of mechanical and electrical subsystems and components. These systems often include on-board monitoring and diagnosis mechanisms configured to monitor the performance and operational status of the subsystems and components. For complex industrial systems, the performance of the monitoring and diagnosis mechanisms may be compromised due to failure of their components, such as sensors, transmission lines, and software components.

U.S. Pat. No. 7,764,188 B2 discloses a system for maintaining machine operation comprising a monitoring device and an electronic control module coupled to a machine. The electronic control module is configured to identify a data collection error associated with the monitoring device. In response to the data collection error, the system then collects a replacement parameter that is interchangeable with the erroneous parameter and downloads the replacement parameter via a wireless communication channel.

Conventional monitoring and alarm systems, however, do not provide mechanisms to analyze and evaluate data collected over a long period of time in order to discover performance issues. Conventional monitoring and alarm systems also fail to monitor data quality of the data generated by various subsystems and components or to provide a warning when the data quality deteriorates. In addition, the performance data collected by conventional monitoring and alarm systems often reflect operation of the industrial system over a very limited period of time and is, thus, not reliable for the system manufacturers or operators to monitor the performance of the system.

SUMMARY

According to one embodiment of the disclosure, a method is disclosed for monitoring and alerting on equipment errors. The method includes receiving data on a periodic basis. The data is indicative of operational states of at least one machine. The method further includes analyzing a quality issue associated with the received data over an alert period greater than one day, determining a type of the quality issue, and generating a warning message including an indication of the quality issue and the type of the quality issue.

According to an alternative embodiment of the disclosure, a system is disclosed for monitoring and alerting on equipment errors. The system includes a data logging device and a server. The logging device receives and stores data from at least one machine. The data is indicative of operational states of the machine. The server receives the data from the logging device on a periodic basis, analyzes a quality issue associated with the received data over an alert period greater than one day, determines a type of the quality issue, and generates a warning message including an indication of the quality issue and the type of the quality issue.

According to a still alternative embodiment, a computer-readable medium is disclosed. The computer readable medium comprises instructions. When executed by a processor, the instructions cause the processor to perform a method for monitoring and alerting on equipment errors. The method includes receiving data on a periodic basis. The data is indicative of operational states of at least one machine The method further includes analyzing a quality issue associated with the received data over an alert period greater than one day, determining a type of the quality issue, and generating a warning message including an indication of the quality issue and the type of the quality issue.

BRIEF DESCRIPTION OF THE DRAWINGS

FIG. 3 is a view of exemplary alarms generated by the monitoring and alarm system of FIG. 1;

FIG. 8 is a view of an electronic message generated by the system of FIG. 1.

DETAILED DESCRIPTION

Figure 1:
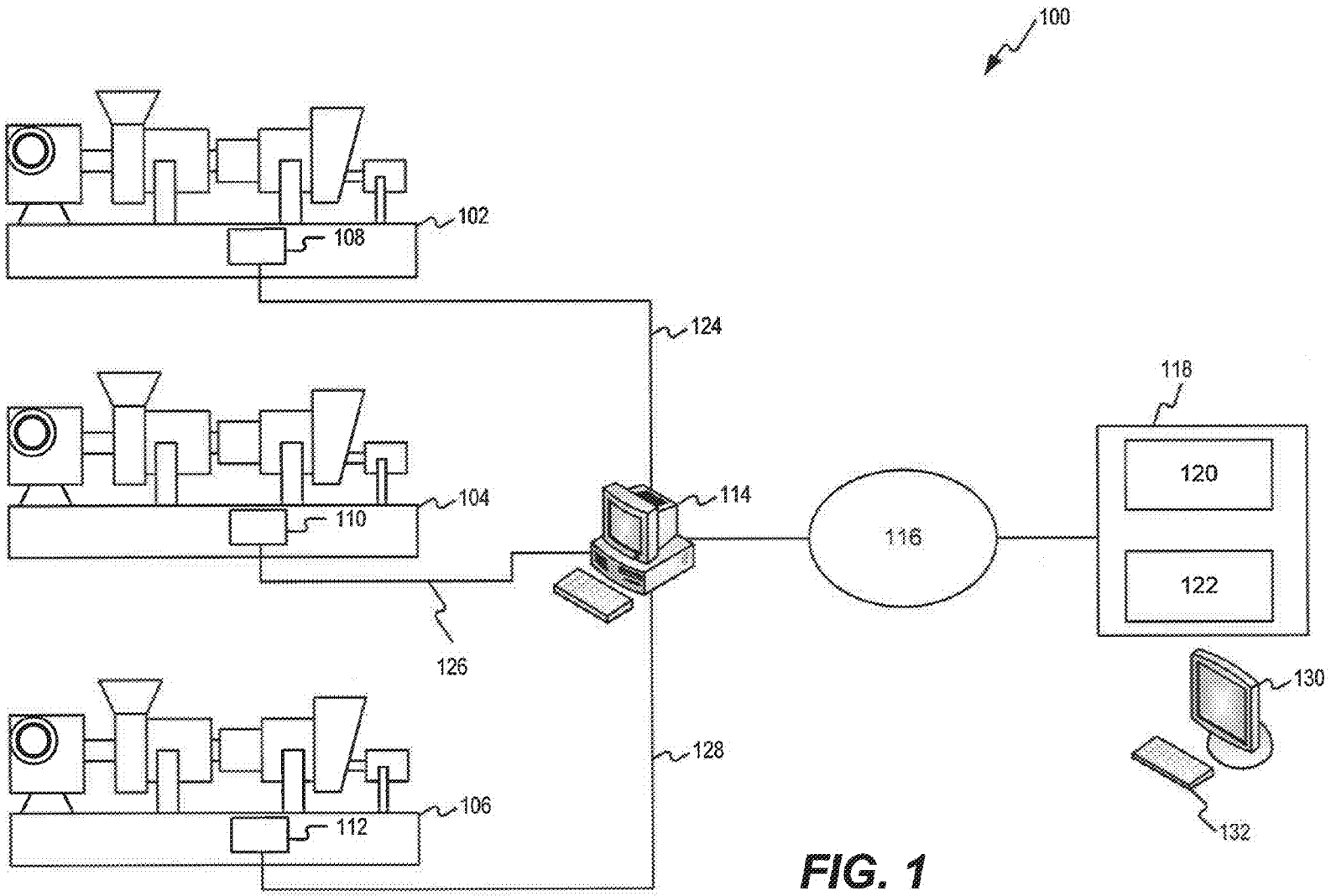
FIG. 1 is a diagram of an exemplary disclosed monitoring and alarm system.

FIG. 1 illustrates a diagram of an exemplary disclosed monitoring and alarm system 100 configured to monitor industrial systems and provide alerts or warning. In particular, system 100 includes a plurality of industrial systems 102, 104, and 106 to be monitored, a data logging device 114, and a remote monitoring server 118.

Systems 102-106 may include gas turbine engine systems, air conditioning systems, power generator systems, or other systems known in the art. Systems 102-106 may be located in one location or different locations and operated by one or more operators. For example, systems 102-106 may be turbine engine systems used to drive respective generator systems for producing electric power.

Systems 102-106 include on-board control units 108, 110, and 112 configured to collect performance and operational data of the systems, respectively. For example, control units 108-112 may each include a processor, a computer-readable medium, and peripheral circuits. The computer-readable medium includes instructions, which may be executed by the processor to control, monitor, and diagnose performance and operations of associated systems 102-106. Control units 108-112 are further configured to receive signals from sensors integrated within systems 102-106. The signals provided by the sensors may include speed signals, pressure signals, temperature signals, output power signals, or other signals known in the art. Upon receiving the signals from the sensors, control units 108-112 extract the performance and operational data from the signals. The performance and operational data may be indicative of, for example, a rotational speed of a shaft, an operational temperature of a given component, a pressure of a particular location within the system, or other parameters known in the art.

In addition, control units 108-112 may monitor the operational states of their associated systems 102-106 and maintain a time counter for each operational state. For example, systems 102-106 may each include a turbine engine system, which may operate in a running state, a standby state, or a downtime state. In the running state, the turbine engine system operates normally to generate output power to drive other equipment, such as a generator. In the standby state, the turbine engine system does not generate power, but is waiting for an operator to provide a start command. As soon as the operator provides the start command through a start button, the turbine engine system transits to the running state. In the downtime state, the turbine engine system is turned off, for example, for routine maintenance work or diagnosis of operational issues or problems.

Control units 108-112 may each periodically determine the operational states of the associated system and maintain, for example, a counter for each operational state of the system. For example, control units 108-112 may determine the operational state of the associated systems based on the rotational speed, the output power, or a combination thereof. Control units 108-112 may each maintain a running counter, a standby counter, and a downtime counter for each of systems 102-106, and increase the corresponding counters accordingly upon determining the operational state of the associated system at a particular time. The counters may record, for example, the number of hours for which the system has operated in a given state. Control units 108-112 may determine the operational states of the associated systems at a predetermined time interval, such as once per minute or once per second, and modify the counters accordingly.

Alternatively, control units 108-112 may each include a single counter for recording the total time for which each of systems 102-106 has operated in the running state. Accordingly, the corresponding control unit pauses the single counter, when a system is in the downtime state or the standby state, and restarts the single counter, when system returns to the running state.

Additionally, control units 108-112 may each include a start counter for recording the number of start operations performed by corresponding systems 102-106. Control units 108-112 increase the start counters each time, when corresponding systems 102-106 are started or when a start is attempted, even if unsuccessful.

Control units 108-112 may establish and start the various counters when the associated systems 108-112 are placed in service and maintain a continuous record of the operational states of the systems in their entire service lifetime. Additionally or alternatively, the counters of control units 108-112 may be selectively reset after, for example, major maintenance work is performed.

Additionally, control units 108-112 may each include a local clock for determining a local time of the location at which the associated system is located. Control units 108-112 may use their local clocks to set the schedule to periodically collect the performance and operational data or to set the counters, as discussed above.

Additionally, control units 108-112 may communicate with data logging device 114 through communication links 124, 126, and 128. Communication links 124-128 may be wired or wireless communication links within an industrial communication network configured to transmit data between control units 108-112 and data logging device 114 according to a known protocol. Data logging device 114 may be located in the same location as one or more of systems 102-106. For example, data logging device 114 may be disposed in a control room near systems 102-106 in a power generator plant or a manufacturing center. According to some embodiments, data logging device 114 may be located remotely from systems 102-406.

Data logging device 114 may be a computer including a network interface configured to communicate with control units 108-112. Data logging device 114 may further include a processor and a computer-readable medium, such as a computer memory, a hard drive, a flash drive, or other storage devices known in the art. The computer-readable medium may store instructions, which are executed by the processor and cause the processor to receive and process the data from control units 108-111. Data logging device 114 may further include a display device for display of the data from control units 108-112 to an operator.

More specifically, data logging device 114 may receive the performance and operational data of systems 102-106 from respective control units 108-112 and store the data in a database within the computer-readable medium. Data logging device 114 may further receive time information generated by the local clocks of control units 108-112 and store the time information in relation to the performance and operational data. The time information may identify the local times at which the performance and operational data are collected.

According to some embodiments, data logging device 114 may periodically pull the data from control units 108-112 at a predetermined time interval or according to a preset schedule. Alternatively, the data logging device 114 may pull the data from control units 108-112 on demand or at a request of the operator. Still alternatively, control units 108-112 may automatically post the data to data logging device 114 periodically or on demand.

Additionally or alternatively, system 100 may include a plurality of data logging devices 114. The plurality of data logging devices 114 may be located in different geographical locations and configured to receive, process, and store data from control units 108-112 of the systems. Alternatively, each data logging device 114 may receive, process, and store data from systems located in multiple geographical locations.

Additionally, data logging device 114 may be configured to communicate with remote monitoring server 118 through a computer network 116. Computer network 116 may be an Internet, a Local Area Network (LAN), a Wide Area Network (WAN), a wireless network, or other networks known in the art. Data logging device 114 may transmit the data collected from control units 108-112 of systems 102-106 to server 118 through computer network 116. The data may include, for example, the performance and operational data (e.g., rotational speeds, pressure measurements, temperature measurements, etc.), the counter data (e.g., the running counters, the standby counters, the downtime counters, etc.), and the time information indicative of the local times of systems 102-106. Data logging device 114 may transmit the data to server 118 in batch or in separate data packets. Data logging device 114 may push the data to server 118 periodically or at the request of the operator. Alternatively, server 118 may pull data from data logging device 114 periodically or at the request of the operator.

The data may be transmitted from data logging device 114 to server 118 on a periodic basis. For example, server 118 may receive or sample the data from data logging device 114 once every second, every minute, every hour, every day, or every multiple days. Data logging device 114 may form a data batch including data collected over the period and transmit the data batch to server 118. Alternatively, the data batch may include data collected at a particular time from the turbine engine system.

Server 118 includes a processor 120 and a computer-readable medium 122. Computer-readable medium 122 may be a computer memory, a hard drive, or other information storage device known in the art. Server 118 may receive the data from data logging device 114 and store the data in computer-readable medium 122. Computer-readable medium 122 further stores computer-executable instructions, which may be executed by processor 120 to process the data received from data logging device 114. The computer-executable instructions may be written in a programming language known in the art.

Server 118 may be coupled to a display device 130 and a user input device 132. Display device 130 may generate a user interface to present the data and processing results to a user or an operator of server 118. The data and the processing results presented by display device 130 may be indicative of the operational states of systems 102-106 and include both real-time and historical data associated with systems 102-106. Display device 130 may also generate alerts or warning messages to draw the attention of the user to a certain aspect of systems 102-106. User input device 132 may include a mouse, a keyboard, a touch pad, etc., and is configured to receive user inputs. Display device 130 and user input device 132 in combination allow the user to interact with server 118 as desired.

According to some embodiments, server 118 may be configured to generate electronic messages, such as e-mails or text messages, and transmit the electronic messages to an e-mail address or to a mobile device. The e-mails and text messages may include, for example, a summary of the data received from data logging device 114 or a processing result generated by server 118. Thus, server 118 may permit the user to view the data and monitor the performance and operation of systems 102-106, even when the user is not present at the location of server 118.

Industrial Applicability

According some embodiments, system 100 may be implemented to monitor any mechanical systems, such as gas turbine engine systems, electrical generators, etc., and assess the quality of the data collected from the systems. Systems 102-106 may form a fleet of machines distributed in different locations. Server 118 may store and analyze data collected at individual time instances and historical data collected over a long period of time, such as, weeks, months, years, or the entire service lifetime of the mechanical systems.

Due to system malfunctions, data in control units 108-112 may be corrupted as described above. Thus, data logging device 114 may not receive correct data from control units 108-112 even when mechanical systems 102-106 operates properly. Interruption of communication links 124-128 may also prevent logging device 114 from properly receiving data or updates from control units 108-112. Additionally, problems of mechanical systems 102-106 themselves may cause abnormalities in the data recorded by control units 108-112. Server 118 may discover errors or quality issues in the data due to various reasons discussed above and provide warnings to an operator alerting the operator to the errors or quality issues. Upon receiving warnings, the operator may then investigate the causes of the errors and take appropriate measures or maintenance steps to cure the problems.

Figure 2:
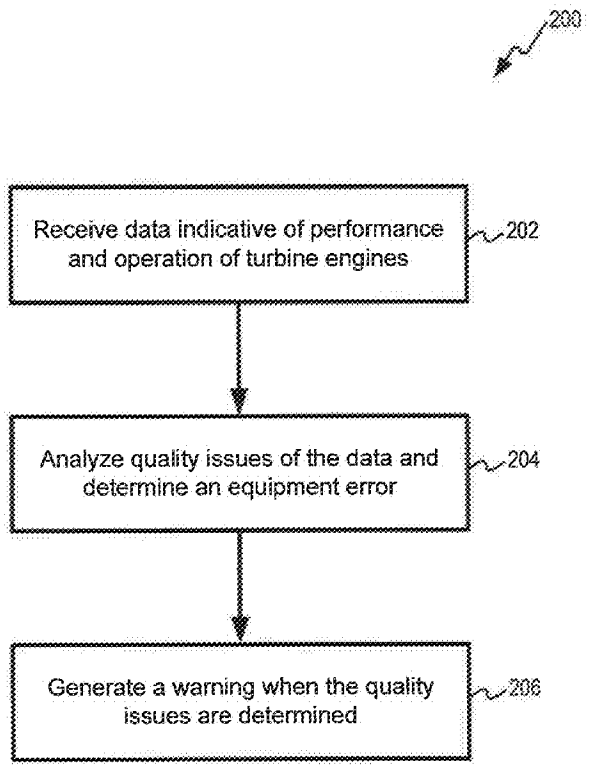
FIG. 2 is a flow chart illustrating an exemplary process performed by the monitoring and alarm system of FIG. 1.

FIG. 2 depicts a flow chart of an exemplary process 200 for using system 100 to monitor a fleet of gas turbine engine systems 102-106 and generating alarms to indicate equipment errors. According to FIG. 2, at step 202, server 118 receives data from data logging device 114. The data may represent performance and operational states of turbine engine systems 102-106 collected at a given time or over a period of time. For example, the data may include rotational speeds of turbine engine systems 102-106 at the given time or the period of time. The data may also includes pressure measurements, temperature measurements, and other parameters collected from turbine engine systems 102-106 at the given time or the period of time.

Additionally or alternatively, the data may further include information from the various counters maintained by control units 108-112 associated with turbine engine systems 102-106. For example, the information from the counters may include the counter data, such as the values of the running counters, the standby counters, the downtime counters, and the start counters maintained by control units 108-112.

Still additionally, the data received by server 118 may further include values of the local clocks maintained by control units 108-112 for turbine engine systems 102-106. The values of the local clocks represent a current time at which the data are collected from corresponding engine systems 102-106.

As discussed above, server 118 may receive the data periodically from data logging device 114 at a predetermined time interval or may request the data from data logging device 114 as desired. For example, server 118 may receive the data from data logging device 114 hourly, daily, or at other time intervals as desired.

At step 204, server 118 processes or analyzes the data received from data logging device 114. According to some embodiments, server 118 checks the counter values and characterizes them according to the time at which the data are collected and the corresponding operational states of the turbine engine systems 102-106. For example, server 118 may determine Whether the received counter values correspond to the running counter, the standby counter, the downtime counter, or the start counter. Additionally, server 118 may match a counter value to a predetermined time interval, such as days, weeks, or months, based on the local time at which the counter value was collected.

According to some embodiments, server 118 may examine and analyze quality issues of the data caused by potential malfunctions of control units 108-112 or data logging device 114. According to some embodiments, server 118 determines whether there are any data points missing from the counter data collected within a predetermined time period, such as days, weeks, or months. In general, server 118 receives the counter data and information on the local time at which the counter data were collected at a predetermined time interval, when all system components operate normally. Due to certain abnormalities or equipment errors, however, portions of the counter data may be missing. This may be caused by malfunctions of control units 108-112, data logging device 114, communication links 124-128, or network 116. As a result, counter data corresponding to certain local times may not be posted or transmitted to server 118.

Alternatively, server 118 may also analyze whether there is any counter data that is uncharacterized or mismatched. Due to equipment malfunctions, characteristics of certain counter data received by server 118 may be lost. For example, server 118 may determine that a set of counter data received from data logging device 114 includes values of unknown counters. Thus, server 118 may mark the values of the unknown counters accordingly.

Additionally, server 118 may compare or cross-reference the data collected at different times and determine whether there are any discrepancies within the data. In general, the values of the counters should continuously count up when all system components operate normally. Due to component malfunctions or improper operations, the values of the counters may decrease or may increase inappropriately. For example, when control units 108-112 are serviced, the counter data stored therein may be inadvertently modified or corrupted, causing the values of the counters to decrease or increase abnormally. As a result, the value of the corresponding start counter increases substantially within the time period, even if no actual engine start is performed. By comparing the values of the same counter collected at different local times, server 116 may determine whether there is any abnormalities or discrepancies in the received data caused by the corruption of the counters.

According to some embodiments, server 118 defines an alert period for analyzing the data collected from turbine engine systems 102-106. For example, server 118 may define the alert period to be multiple days, a week, multiple week, a month, multiple months, a year, multiple years, or any other possible length of time. Server 118 may then analyze the data collected within that alert period for any potential quality issues. Additionally, server 118 may customize the alert period for each individual one of turbine engine systems 102-106. For example, server 118 may use different alert periods for turbine engine systems 102-106 according to their operational characteristics, such as length of service or frequency of maintenance, or as desired by the operator.

At step 206, server 118 generates a warning message when quality issues of the received data are determined. As shown in FIG. 3, server 118 may generate a user interface 300 on display device 130, presenting one or more warning messages 302-312. Warning messages 302-312 may include descriptions indicating to a user the specific quality issues discovered by server 118. For example, message 302 includes an alert name, "Excessive Start," with an alert type, "Data," indicating that the value of the start counter has increased abruptly due to corruption of data within the control unit. Message 304 also includes an alert name, "Excessive Start," but with an alert type, "Operation," indicating that the value of the start counter has increased abruptly due to problems of the turbine engine system itself. Message 306 includes an alert name, "Engine Hours—Excessive Positive Step," with the alert type, "Data," indicating that the value of the running counter has increased abruptly due to data quality issues. Message 308 includes an alert name, "Engine Hours—Negative Step," with the alert type, "Data," indicating that the value of the running counter has reversed or decreased due to, for example, program corruptions. Message 310 includes an alert name, "Unit Not Posting>=[5] Days," with the alert type, "Data," indicating that there is a potential communication problem between a control unit and data logging device 114, causing missing data for at least a 5-day period. Message 312 includes an alert name, "Age of Uncharacterized Hours>=[3] days," with the alert type, "Data," indicating that portions of day collected over at least a 3-day period are uncharacterized or mismatched.

Interface 300 may further allow a user to choose one of messages 302-312 using, for example, a mouse or a keyboard. Server 118 may then display a graphical representation of the selected warning message, including additional details of the quality issues of the data. FIGS. 4-7 illustrate exemplary embodiments of the graphical representations of warning messages 302-312 shown in FIG. 3.

Figure 4:
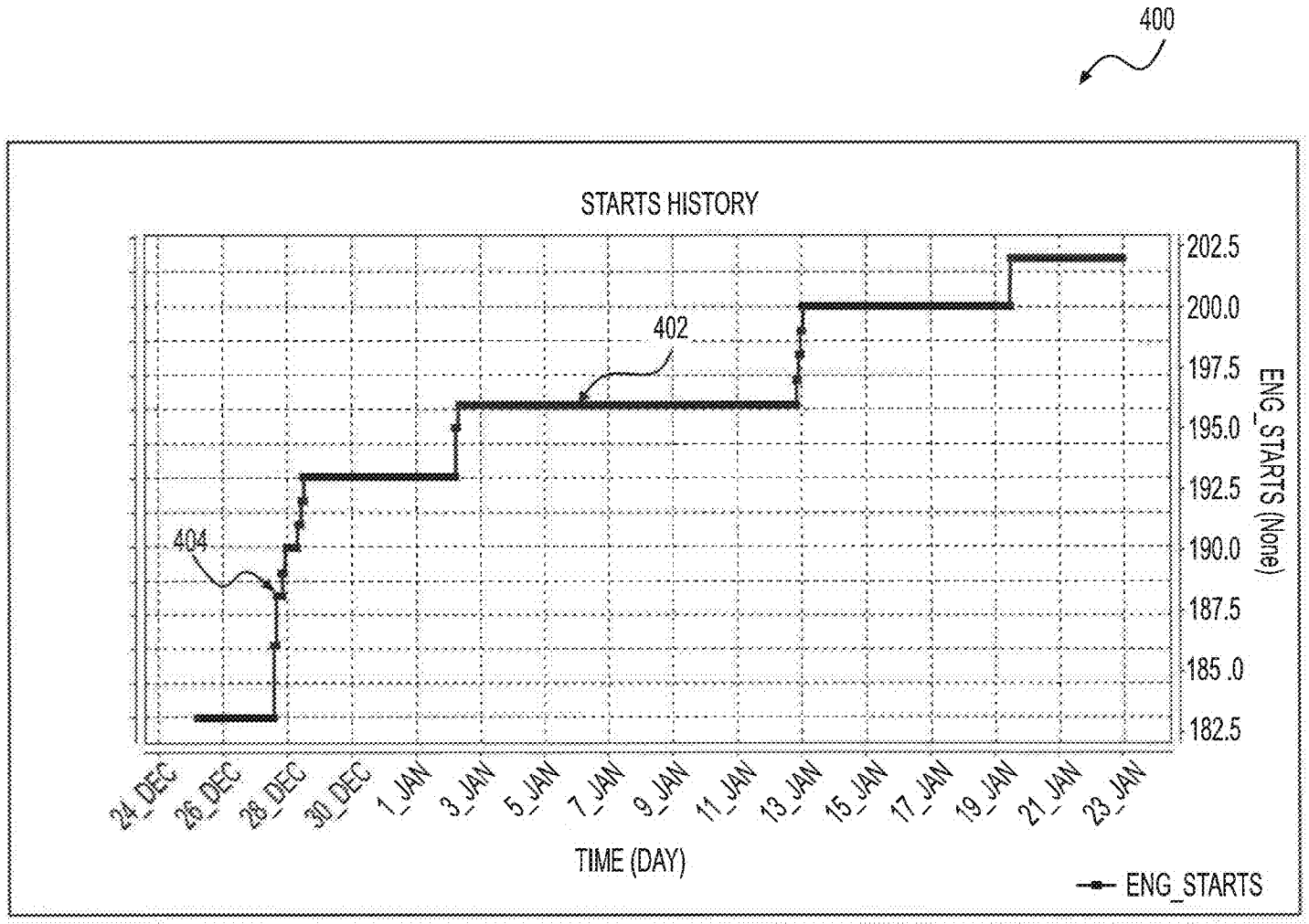
FIG. 4 is a view of a graphical alarm message indicating excessive starts of a turbine engine system.

FIG. 4 shows an exemplary engine start counter diagram 400 displayed by server 118 corresponding to messages 302 and 304 of FIG. 3. Specifically, diagram 400 includes an engine start curve 402 representing the values of a start counter within an alert period of a month. An abrupt increase 404 of curve 402 shows that, on a certain day within that alert period, the start counter records repeated engine starts. These repeated engine starts may be generated by an operator of the turbine engine system making repeated attempts to start the system. Alternatively, this repeated engine start operations may be recorded due to the corruption of the data within the control unit, even when the turbine engine itself operates properly. The steps in the engine start curve 402 indicates to the user of the server potential malfunctions or errors in the turbine engine system, causing the abrupt increase in the value of the start counter.

According to a further embodiment, server 118 may determine whether the increase in the value of the start counter is a data quality issue caused by the corruption of the data within the control unit or by the operator's attempts to start the engine. For example, when the value of the start counter increases by more than 10 within a given hour, server 118 may determine that there is a data quality issue caused by the corruption of the data within the control unit. Alternatively, when the value of the start counter increases by less than 10 within a given hour, server 118 may determine that there is a problem in the turbine engine system itself that causes the operator to repeatedly start the engine. Additionally, server 118 may generate different types of warning messages (e.g., messages 302 and 304) according to the results of the determination described above.

Figure 5:
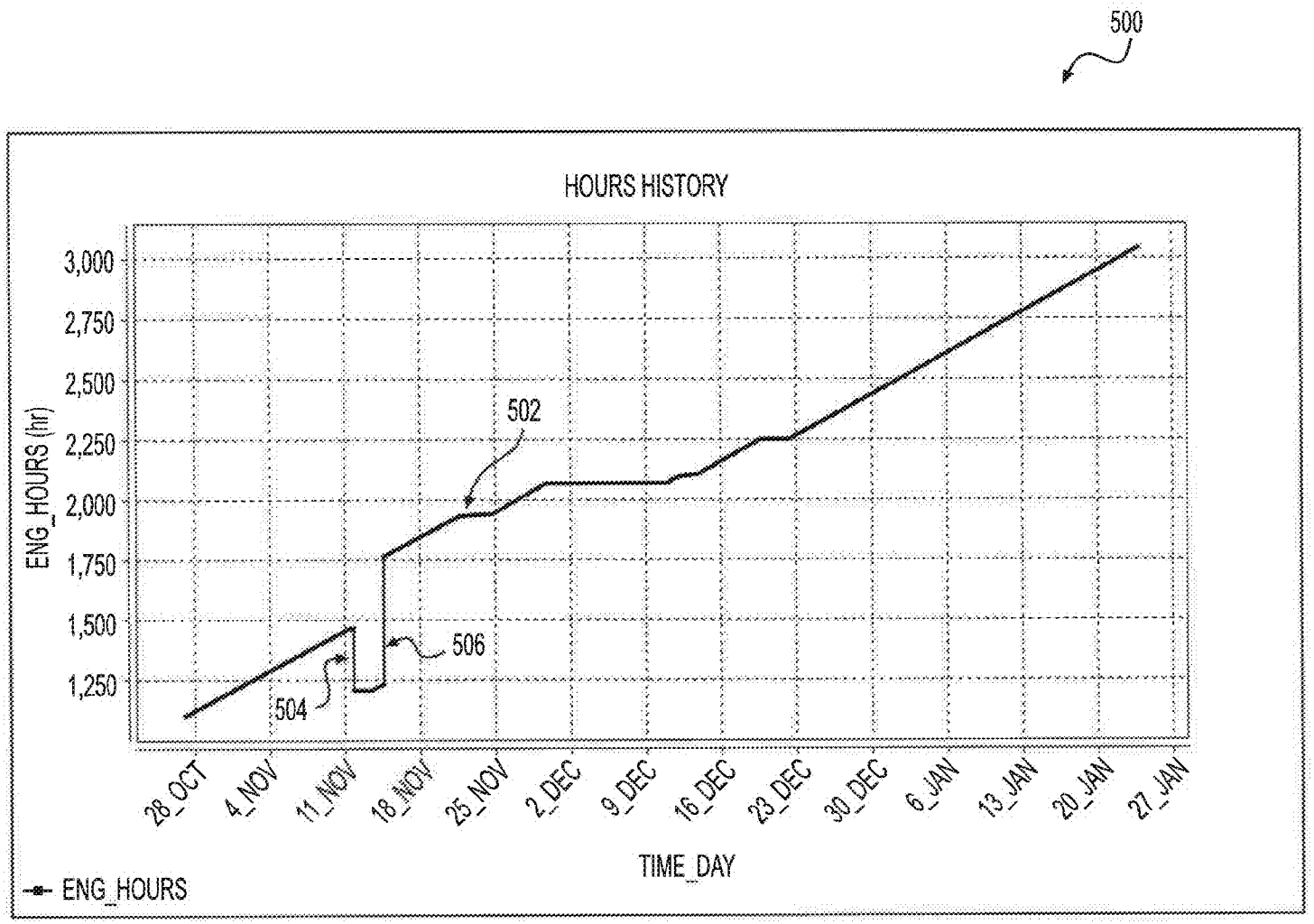
FIG. 5 is a view of a graphical alarm message indicating a negative step in the engine hours of the turbine engine system.

FIG. 5 shows an engine hour diagram 500 displayed by server 118 corresponding to messages 306 and 308 of FIG. 3. Specifically, diagram 500 includes an engine hour curve 502 representing the number of hours for which a turbine engine system has operated during an alert period of a month. Server 118 may generate engine hour curve 502 based on the values of the running counter, the standby counter, and the downtime counter discussed above. In general, engine hour curve 502 should increase monotonically and continuously as the engine system continues to be in service in the alert period. As shown in FIG. 5, however, engine hour curve 502 for this particular engine includes a negative step 504, indicating a decrease or a reverse in the engine hours. Negative step 504 suggests a potential malfunction of the control unit associated with the turbine engine system due, for example, to the counters being corrupted as a result of improper operation or maintenance work, and may trigger the "Engine Hours-Negative Step" message 308 as shown in FIG. 3. Additionally, engine hour curve 502 also includes a positive step 506, indicating an abrupt increase in the engine hours. The abrupt increase in the engine hours also suggests a potential malfunction of the control unit and may trigger the "Excessive Positive Step" message 306 as shown in FIG. 3.

Figure 6:
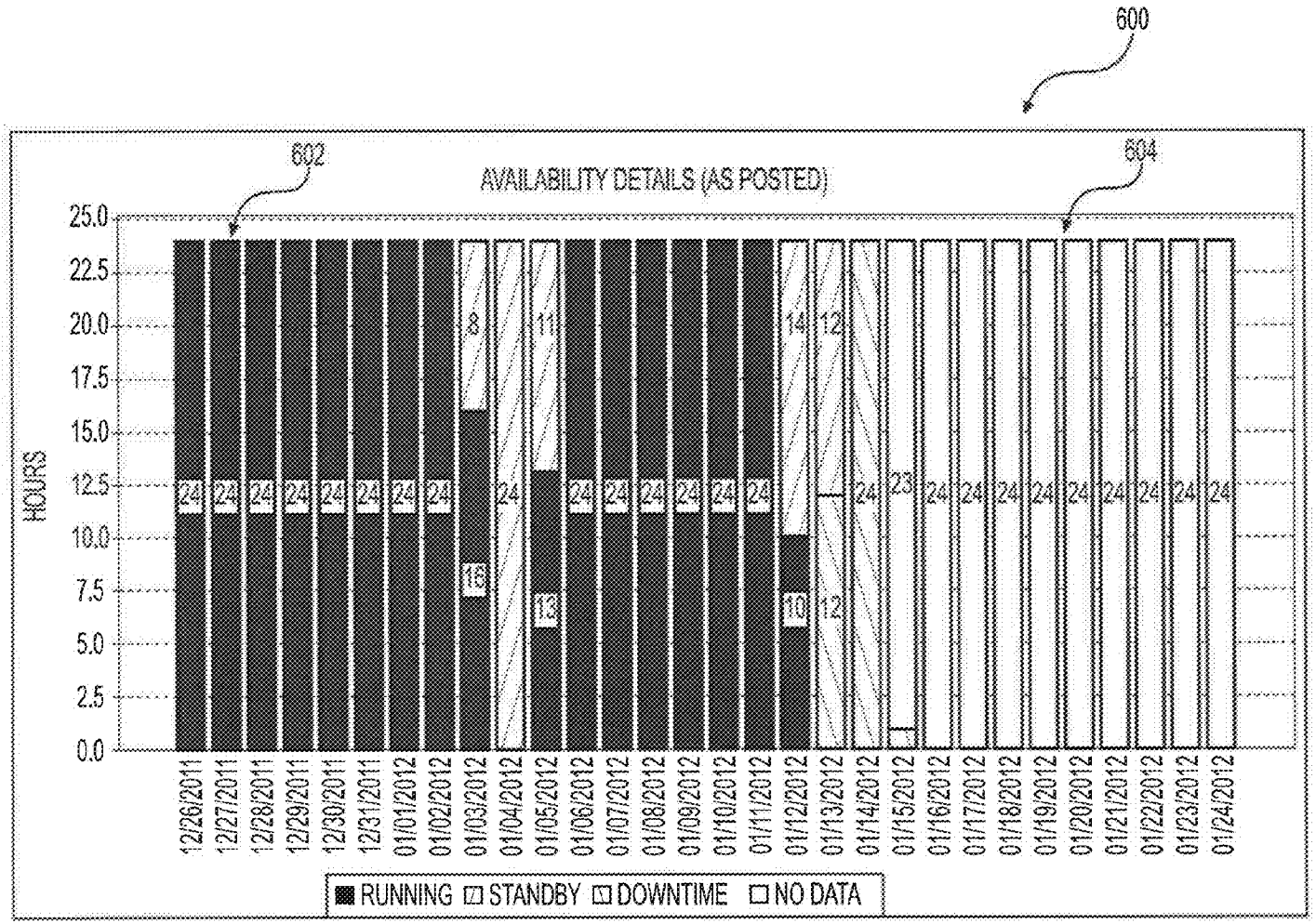
FIG. 6 is a view of a graphical alarm message indicating missing engine hour data from the turbine engine system.

FIG. 6 shows an engine availability diagram 600 generated by server 118 corresponding to message 310 of FIG. 3. Specifically, engine availability diagram 600 shows a temporal distribution of the operational states of a particular turbine engine system over an alert period, such as a month, in this example. The horizontal axis of diagram 600 represents individual days within the alert period, and the vertical axis represents the hours within each day. Diagram 600 further includes bar elements 602, coded with different patterns, indicating the operational states in which the engine system operates on a given day. For example, as shown in FIG. 6, from 12/26/2011 to 01/02/2012, the system operated in the running state to provide normal output power. On 01/03/2012, the system was in the downtime state for a portion of that day. And on 01/04/2012, the system was in the downtime state for the entire day. On 01/04/2012, the system operated in the standby state for the entire day.

Diagram 600 further alerts the user of the server to the missing data within the time period as indicated in message 306. Specifically, diagram 600 shows that from an early part of 01/15/2012 through 01/24/2012, the counter data 604 are entirely missing, thus indicating potential equipment errors or malfunctions within that time period. Therefore, diagram 600 allows a user of server 118 to pinpoint specifically when a problem or error occurred relating to a particular engine system and monitor the data quality over a long period of time (e.g., weeks, months, years, etc.).

Figure 7:
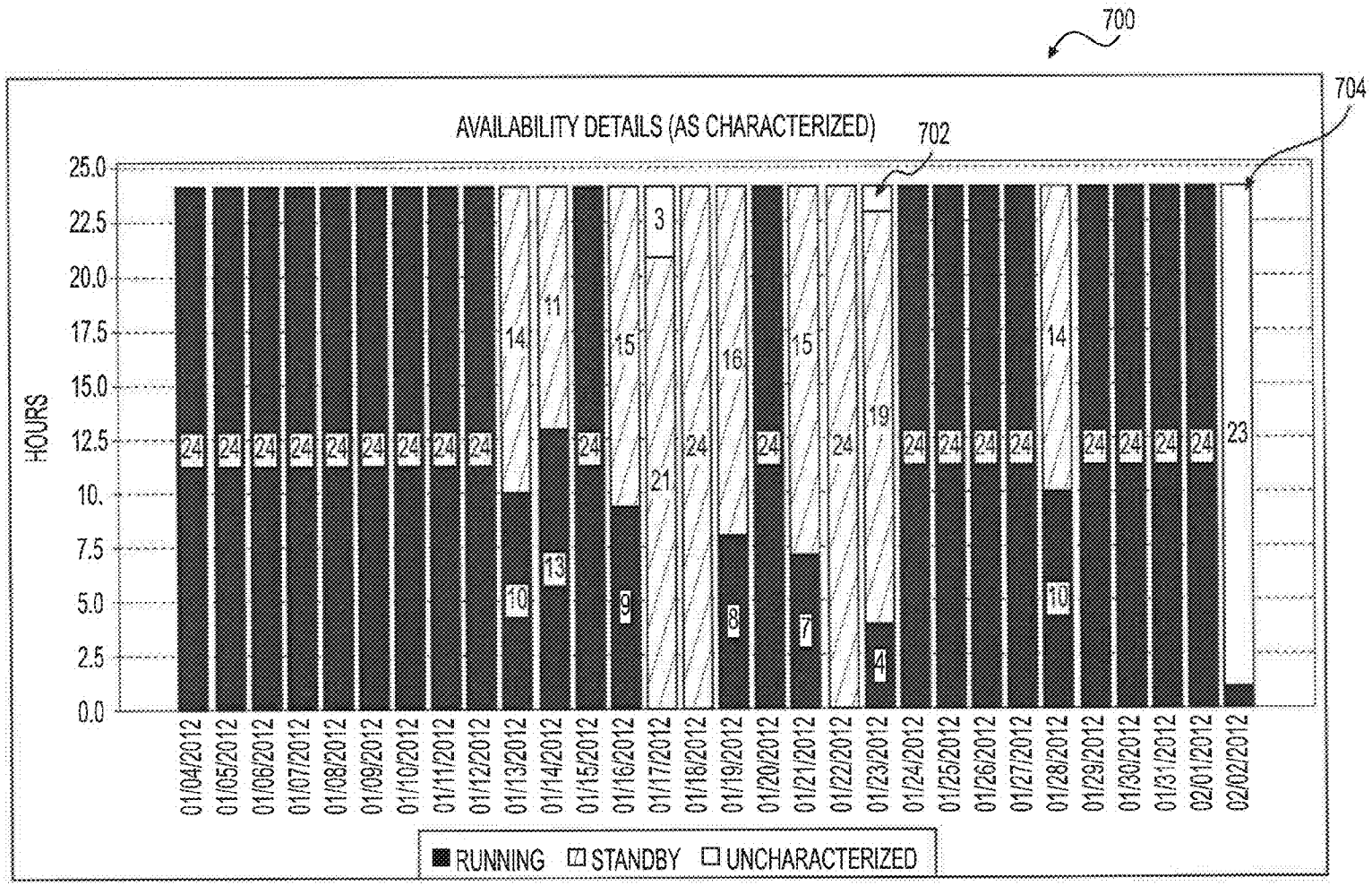
FIG. 7 is a view of a graphical alarm message indicating uncharacterized hours data from the turbine engine system.

FIG. 7 shows another engine availability diagram 700 generated by server 118 corresponding to message 312 of FIG. 3. Similar to diagram 600, diagram 700 shows the temporal distribution of the operational states of a turbine engine system within an alert period of a month. Additionally, diagram 700 further shows that portions of data 702 and 704 collected on 01/17/2012, 01/23/2012, and 02/02/0212 are uncharacterized or mismatched. For example, due to equipment errors, the data received by server 118 for the corresponding times may include no indication of the corresponding operational states of the engine system. Thus, server 118 cannot determine whether the engine system operated in the running state, the standby state, or the downtime state. Diagram 700 provides a visual representation of the timing and duration of the uncharacterized data, and allows a user of the server to pinpoint the specific instances of the uncharacterized data 702 and 704.

In addition to displaying the warning message and the graphical diagrams on display device 113, server 118 may further generate an electronic message and transmit it to a mobile device or an e-mail account of the user, including the warning messages or the graphical diagrams discussed above. FIG. 8 shows an exemplary embodiment of the electronic message 800 generated by server 118. In general, electronic message 800 includes similar information as shown in user interface 300. Messages 302-312 may be listed in a list 802 included in electronic message 800. Upon receiving electronic message 800, the user may select on the mobile device or a computer an individual warning message from list 802. The mobile device or the computer may then display a graphical diagram, similar to those of FIGS. 4-7, corresponding to the selected warning message.

According to some embodiments, the warning messages and graphical diagrams generated by server 118 may prompt the user to investigate the source of the equipment error that caused the data quality problem. For example, the user may determine the specific day and time at which the operator of the engine system made repeated attempts to start the system. The user may also determine the specific day and time at which the reverse of the counter value occurred. The user may also determine the specific day and time at which the control unit stopped posting the counter data to data logging device 114. The user may also determine the specific day and time at which the received data becomes uncharacterized. Based on the analysis, the user may then take proper measures to cure the equipment errors. The system may allow the user to review the history of the data over a long period of time, e.g., weeks, months, or years, and monitor the turbine engine systems in a broader time range.

According to some embodiments, server 118 may be integrated into a business decision system and provide the analysis result to assist business decisions by a business entity. For example, server 118 may provide the data to a sales department or a service department of a manufacturer of systems 102-106 and allow the manufacturer to make pricing decisions, based on the data and the processing results from server 118. For example, based on the values of the running counter, the standby counter, and the downtime counter collected over a relatively long time period (e.g., the past three years), server 118 may provide pricing information to the sales department to determine the price of a service contract for further maintenance of the turbine engine system. Alternatively, server 118 may provide pricing information on a brand new system based on the counter data when a customer seeks to replace an old system with the new system.

It will be apparent to those skilled in the art that various modifications and variations can be made to the disclosed systems. Others embodiments will be apparent to those skilled in the art from consideration of the specification and practice of the disclosed systems. It is intended that the specification and examples be considered as exemplary only, with a true scope being indicated by the following claims and their equivalents.

What is claimed is:

1. A method for monitoring and alerting on equipment errors, the method comprising:

receiving data on a periodic basis, the data being indicative of operational states of at least one machine;

analyzing a quality issue associated with the received data over an alert period greater than one day;

determining a type of the quality issue; and generating a warning message including an indication of the quality issue and the type of the quality issue.

2. The method of claim 1, further comprising servicing the at least one machine to correct the quality issue in response to the warning message.

3. The method of claim 1, wherein the received data includes an indication of an amount of time for which the machine has operated in the alert period.

4. The method of claim 1, wherein the received data includes values of a plurality counters indicative of a number of hours for which the machine has operated in a plurality of predetermined states.

5. The method of claim 4, wherein analyzing the quality issue associated with the received data further comprises determining whether the received data is missing a portion.

6. The method of claim 4, wherein analyzing the quality issue associated with the received data includes characterizing the received data in accordance with the operational states of the at least one machine.

7. The method of claim 4, wherein analyzing the quality issue associated with the received data includes comparing at least two portions of the received data collected at different times.

8. The method of claim 7, further comprising determining a step change in the values of the counters based on the comparison.

9. The method of claim 7, wherein the values of the counters include:

a value of a running counter indicative of a number of hours for which the machine has been in service; and a value of a start counter indicative of a number of times for which the machine has been started.

10. The method of claim 1, further comprising receiving the data from a plurality of gas turbine engine systems.

11. The method of claim 1, further comprising receiving the data from a data logging device on the periodic basis, wherein the periodic basis is adjustable.

12. The method of claim 1, wherein the alert period includes a plurality of days.

13. The method of claim 1, wherein the at least one machine includes a fleet of machines.

14. The method of claim 13, further including customizing the alert period for an individual machine of the fleet of machines.

15. The method of claim 13, further comprising:

transmitting the data from the fleet of machines to a data logging device; and receiving the data from the data logging device.

16. The method of claim 13, wherein the fleet of machines is stationary.

17. The method of claim 1, wherein the warning message is indicative of equipment errors occurring within the alert period.

18. A system for monitoring and alerting on equipment errors, the system comprising:

a data logging device configured to receive and store data from at least one machine, the data being indicative of operational states of the at least one machine; and a server configured to:

receive the data from the logging device on a periodic basis;

analyze a quality issue associated with the received data over an alert period greater than one day;

determining a type of the quality issue; and generate a warning message including an indication of the quality issue and the type of the quality issue.

19. The system of claim 18, wherein the at least one machine includes a fleet of gas turbine engine systems.

20. The system of claim 19, wherein the gas turbine engine systems are disposed at different locations.

21. The system of claim 19, wherein the gas turbine engine systems are stationary.

22. The system of claim 19, wherein the gas turbine engine systems continuously operate over a period of at least one month.

23. A computer-readable medium comprising instructions stored thereon, the instructions, when executed by a processor, causing the processor to perform a method for monitoring and alerting on equipment errors, the method comprising:

receiving data on a periodic basis, the data being indicative of operational states of at least one machine;

analyzing a quality issue associated with the received data over an alert period greater than one day;

determining a type of the quality issue; and generating a warning message including an indication of the quality issue.

24. The computer-readable medium of claim 23, wherein the type of the quality issue indicates that the quality issue is caused by a corruption of data within a control unit associated with a turbine engine system.

25. The computer-readable medium of claim 23, wherein the type of the quality issue indicates that the quality issue is caused by a malfunction of a turbine engine system.

* * * * *